United States Patent [19]

Wilding

[11] 4,087,056

[45] May 2, 1978

[54] TEXTILE APPARATUS

[75] Inventor: Ronald Wilding, Blackburn, England

[73] Assignee: J. & J.A. Porter Limited, Blackburn, England

[21] Appl. No.: 713,435

[22] Filed: Aug. 11, 1976

[30] Foreign Application Priority Data

Oct. 10, 1975 United Kingdom ..... 41553/75

[51] Int. Cl.[2] ..... B65H 54/30

[52] U.S. Cl. ..... 242/43 R; 242/18.1

[58] Field of Search ..... 242/43 R, 43.1, 18.1

[56] References Cited

U.S. PATENT DOCUMENTS

| | | | |
|---|---|---|---|
| 1,126,809 | 2/1915 | McKean | 242/43 R |
| 1,353,475 | 9/1920 | Holt et al. | 242/43 R |
| 1,493,719 | 5/1924 | Zippel | 242/43 R |
| 1,544,257 | 6/1925 | McKean | 242/43 R X |
| 1,591,138 | 7/1926 | McKean | 242/43 R |
| 1,763,246 | 6/1930 | McKean | 242/18.1 |
| 1,950,990 | 3/1934 | McKean | 242/18.1 |
| 3,741,491 | 6/1973 | Richter | 242/18.1 |
| 3,884,426 | 5/1975 | Hermanns | 242/18.1 X |

FOREIGN PATENT DOCUMENTS

| | | | |
|---|---|---|---|
| 612 of | 1903 | United Kingdom | 242/18.1 |

*Primary Examiner*—Stanley Gilreath
*Attorney, Agent, or Firm*—Fleit & Jacobson

[57] ABSTRACT

There is disclosed a yarn traverse mechanism comprising means for positively feeding yarn at a uniform speed to a yarn traverse arm, and means for moving the yarn traverse arm to and fro to lay the yarn on a tapered bobbin to form a package, said arm moving means comprising a cam shaped to vary the axial movement of the arm in relation to the axial position of the arm in relation to the cam and thus to the diameter of the bobbin to maintain the tension of yarn laid on the bobbin substantially uniform. The cam is a scroll cam.

5 Claims, 5 Drawing Figures

TEXTILE APPARATUS

This invention relates to textile apparatus and in particular to yarn traverse mechanisms and textile apparatus having such mechanisms.

When weaving yarn it is desirable that the yarn be drawn from tapered packages, particularly for weaving at higher speeds. Mechanisms are known for winding tapered or conical packages but these are not capable of satisfactorily and reliably winding a conical package if the yarn is fed to the winding mechanism at a uniform speed, particularly at higher speeds.

According to this invention a yarn traverse mechanism comprises means for positively feeding yarn at a uniform speed to a yarn traverse arm, and means for moving the yarn traverse arm to and fro to lay the yarn on a tapered bobbin to form a package, said arm moving means comprising a cam shaped to vary the axial movement of the arm in relation to the axial position of the arm in relation to the cam and thus to the diameter of the bobbin to maintain the tension of yarn laid on the bobbin substantially uniform.

Preferably the cam is a scroll cam having a groove co-operable with the traverse arm.

The shape of the cam depends on the degree of taper of the bobbin, but most bobbins have the same taper.

The invention also includes textile apparatus having such a traverse mechanism.

The traverse mechanism avoids temporary or permanent build-up of yarn and lays the yarn on the bobbin at the uniform speed determined by the feed means.

The bobbin is preferably mounted for free rotation and is driven by frictional contact of the bobbin or package with a cylindrical roller driven at the same speed as a positive feed roller for the yarn.

The invention may be performed in various ways and one specific embodiment will now be described by way of example with reference to the accompanying drawings, in which.

Figure 1:
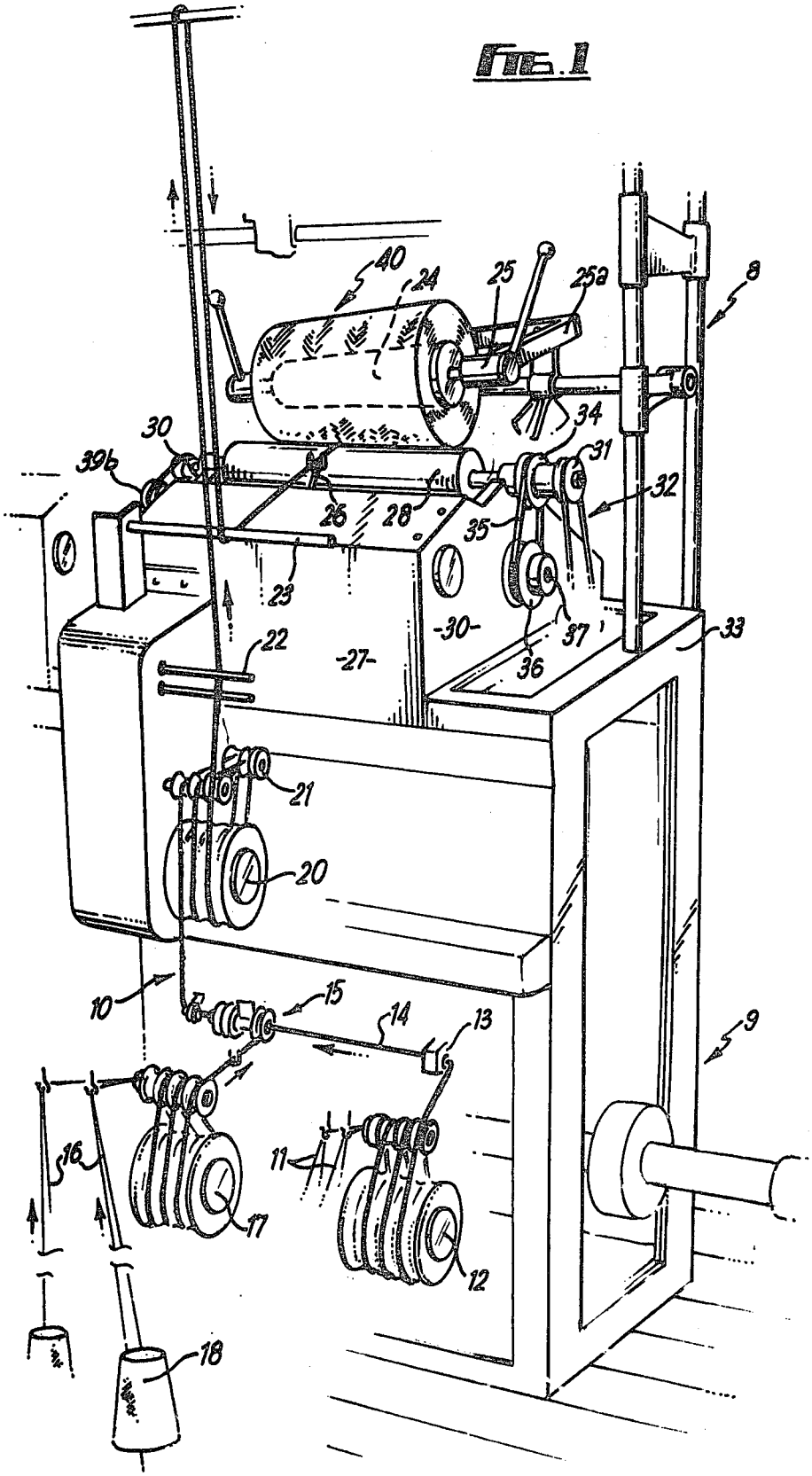
FIG. 1 is a perspective view of part of a Hirchburger Texturing Machine modified to include apparatus according to the invention.
Figure 2:
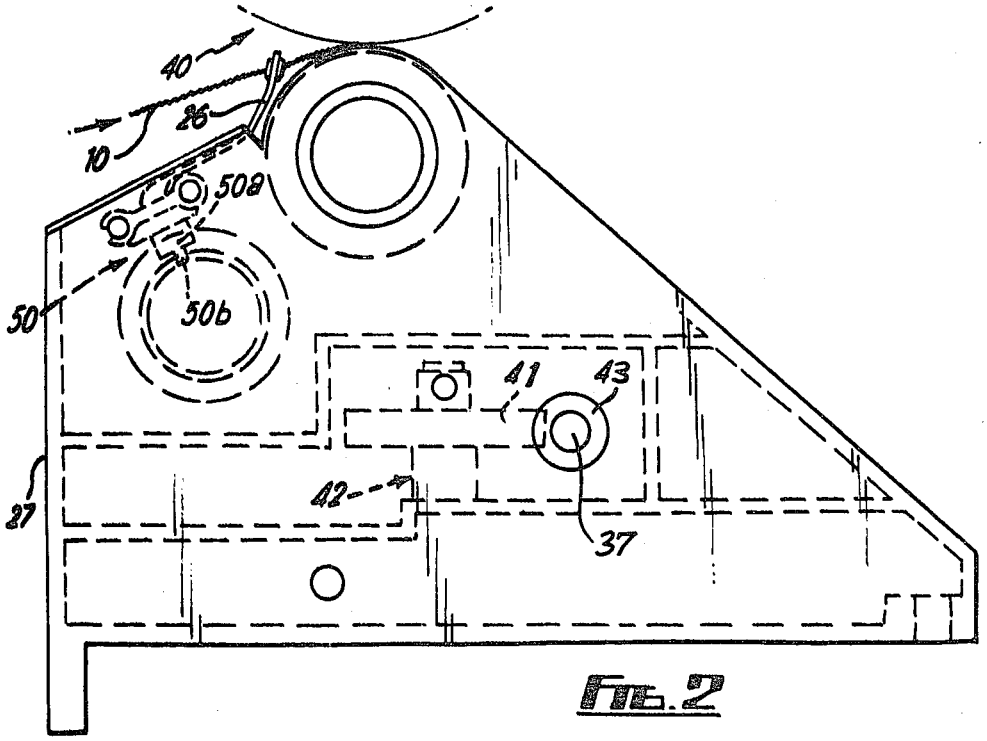
FIG. 2 is a side elevation of part of FIG. 1.
Figure 4:
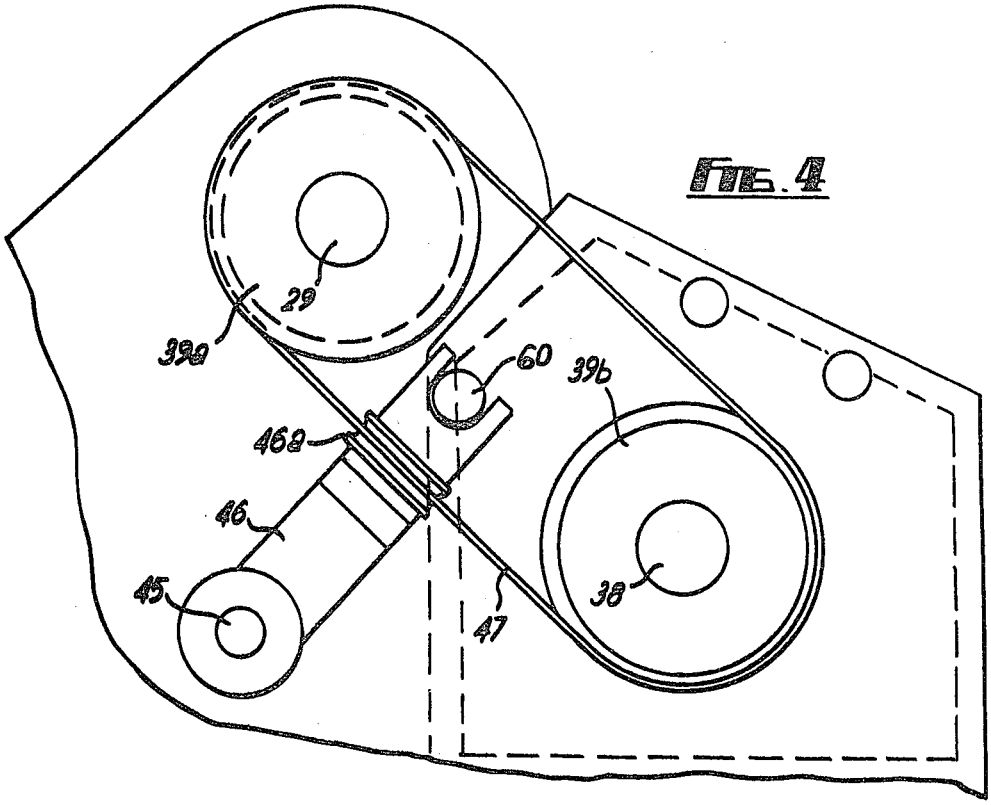
FIG. 4 is a side elevation of part of the other side to FIG. 2.

Referring to FIG. 1, the machine is, in the illustrated embodiment, used to produce a textured yarn 10 from synthetic monofilaments of nylon, the textured yarn being used for example in upholstery fabrics.

The rolls 12, 17 and 20 are positively driven by an electric motor (not shown) at uniform, but adjustable, speeds.

A plurality of synthetic monofilaments 11 each from a separate tapered or conical package (not shown) are drawn by a rotating roll 12 mounted on robust frame 9 to a common guide eye 13 also mounted on frame 9 and pass as a single strand 14 axially through a known texturing device 15 mounted on the frame.

A further plurality of synthetic monofilaments 16 are drawn by rotating roll 17 from respective conical packages 18 and fed to the device 15. The device 15 includes a generally cylindrical chamber. Compressed air is supplied in known manner to the interior of the chamber of device 15 to produce therein an air vortex which causes the yarns 16 to be wrapped around the axial core yarn 14 in an irregular manner to produce a bulky strand 10. The yarns 16 are called the effect yarns since they produce the visual effect of the yarn 10. Water may, in known manner, be supplied to device 15 to soften the core yarn 14 during the texturing step. The whole texturing step is well known, the yarn 10 being known as TASLAN yarn.

So that the textured yarn 10 can be woven it is necessary to wind it on to a bobbin. The present apparatus is designed to wind it into a tapered or conical package as distinct from a cylindrical package or cheese.

The yarn 10 is fed by forward feed roll 20 over suitable guides 21, 22, 23 to a tapered bobbin 24 carried on a mounting device 25 which is known and comprises end arms **25*a* (only one shown) pivoted to a frame 8 secured in frame 9** for moving the package and bobbin to and from the winding position for loading of a fresh bobbin and removal of a completed package.

Figure 3:
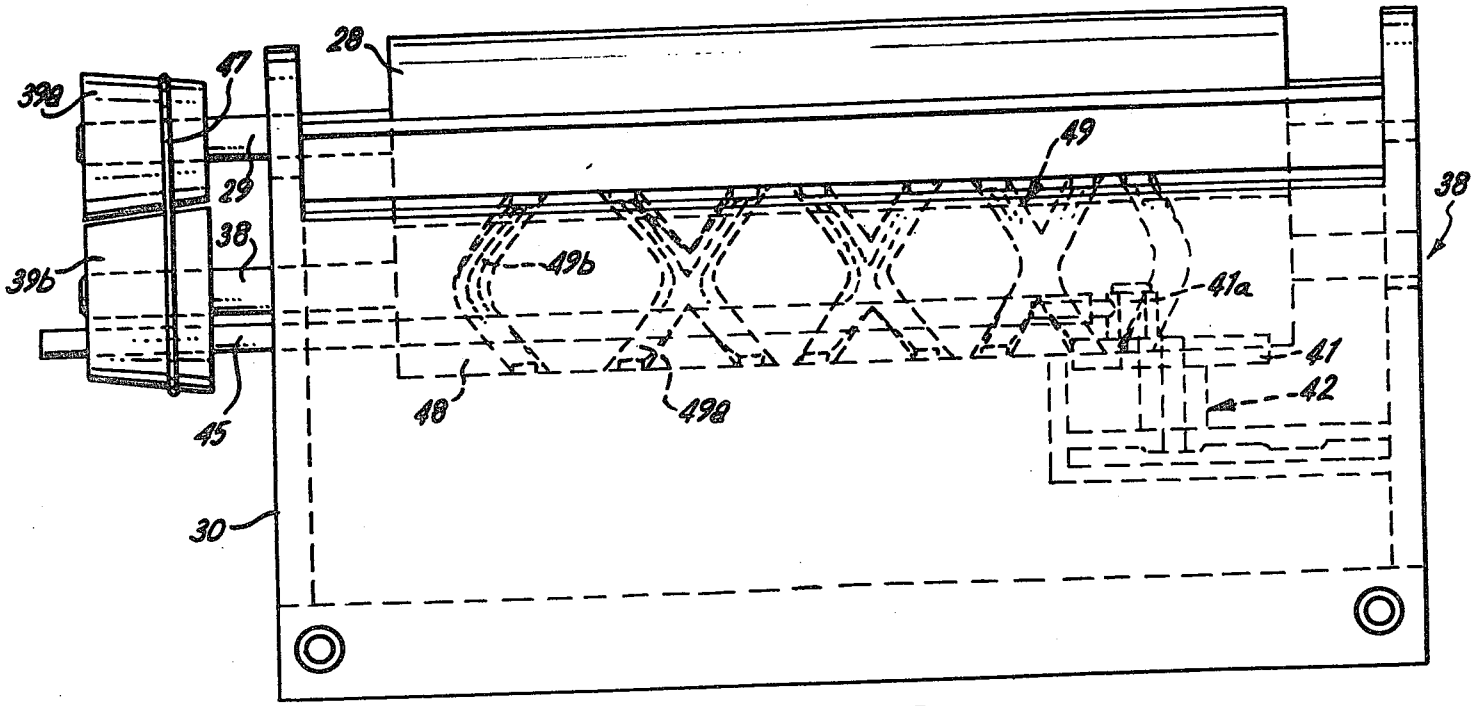
FIG. 3 is a front elevation of FIG. 2.

The yarn 10 is engaged by an arm 26 of a traverse mechanism behind a casing 27. The bobbin 24 is freely mounted for rotation in device 25 and is driven by peripheral contact with a cylindrical roller 28 having a central shaft 29 mounted at its ends in bearings in a frame 30 and carrying at one end a gear wheel 31 driven through gear and chain device 32 by an electric motor (not shown) mounted in a housing 33. The roller 28 rotates at a uniform speed. The shaft 29 also carries a further gear wheel 34 driving a chain 35 which drives a gear 36 on a shaft 37 parallel to the shaft 28. The shaft 37 drives a worm wheel 41 and worm 43, forming a reduction gear 42 connected to a drive shaft 45 carrying an arm 46 carrying a fixed roller **46*a* engaging a drive chain or cord 47 to move the chain to and fro over conical pulleys 39*a*, 39*b*. The arm 46 is slotted at its free end to receive a rod guide 60. The pulley 39*a* rotates with shaft 29 and the pulley 39*b* rotates with shaft 38. Rotation of the reduction gear 42 causes the shaft 45 to slowly reciprocate to the left and right as seen in FIG. 3 through a stud 41*a* eccentrically mounted on the wheel 41 and connected to shaft 45**.

A rotatable shaft 38 parallel to the shaft 37 is mounted in bearings in frame 30 and carries a generally cylindrical scroll cam 48 having an endless groove 49 in its peripheral surface in which is movable the yarn traverse arm 26 via a follower 50. The groove 49 has a wider part **49*a* and a central, narrower and deeper, part 49*b*. The follower 50 has a disc shaped part 50*a* engaging in grooves 49*a* and a narrower part 50*b* engaging in groove 49*b*. Rotation of the shaft 38 causes the arm 26 to move in the groove 49 and the groove is so shaped as to traverse the arm 26 to and fro across the bobbin 24 to form the tapered package 40**.

Figure 5:
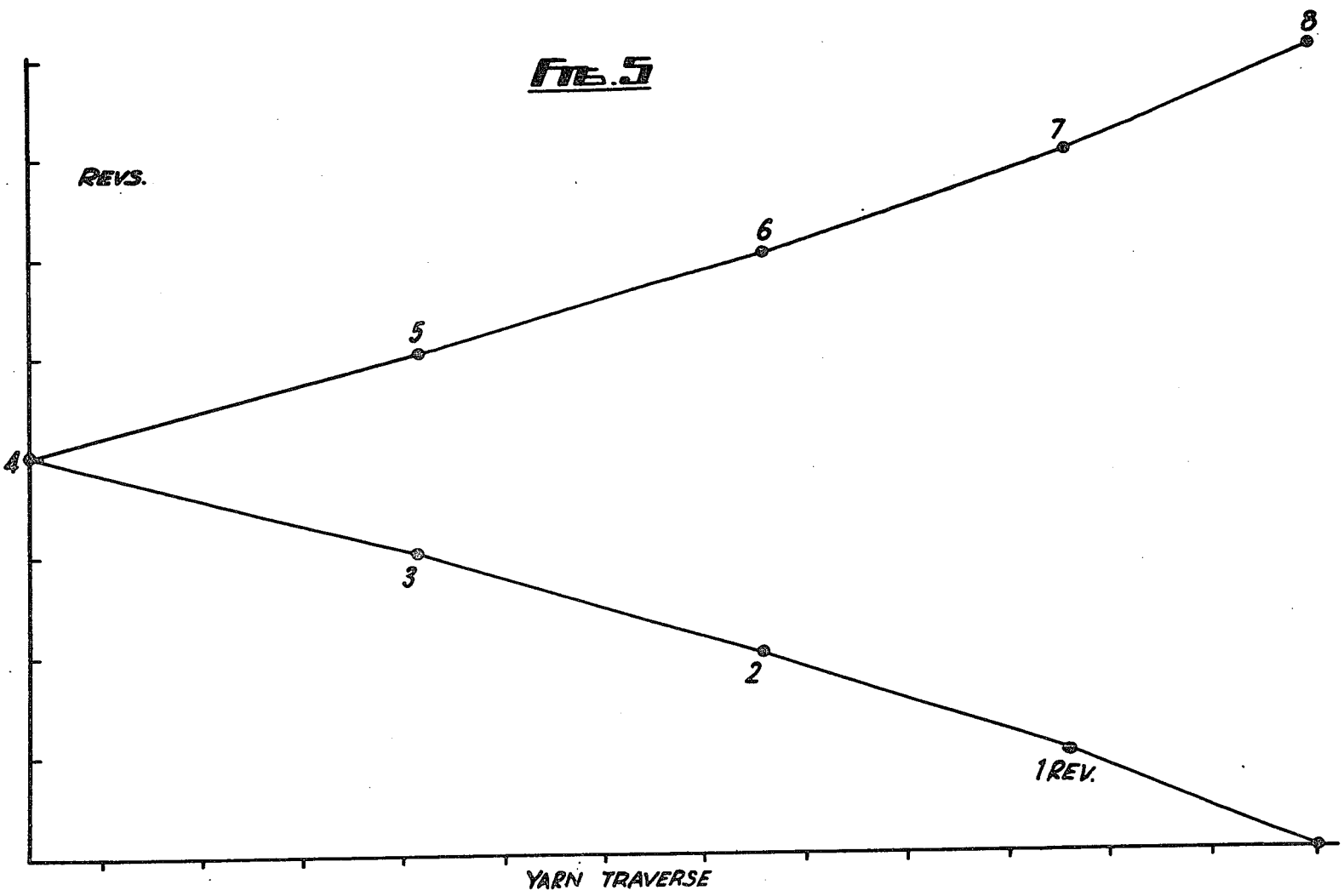
FIG. 5 is a graph of the traverse position of the traversing mechanism.

It will be appreciated that as the shaft 45 is reciprocated the diameter of that portion of conical pulley **39*b* engaged by cord 47 changes, and thus the speed of rotation of scroll cam 48 also changes in relation to the speed of rotation of the shaft 29 and bobbin 24. Thus preventing undesirable ribboning of the yarn on the bobbin. FIG. 5 shows the axial extent of traverse of the traverse arm 26, measured from the wider right hand end of the bobbin, for successive revolutions of the shaft 38 from which it can be seen that one complete to and fro traverse of arm 26 requires eight turns of the shaft 38**.

The axial distances covered during successive revolutions of the shaft 38 and cam 48 are in the ratio 24:30:34:39:39:34:30:24 and the groove 49 is shaped so that the curve representing axial distance covered in relation to revolutions covered from a datum start position with the arm 26 at the wider right hand end of the bobbin is smooth and continuous.

The particular yarn texturising process requires that the feed roll 20 rotate at a uniform speed. The thickness of yarn laid on the tapered bobbin is substantially uniform along the length of the bobbin. Because the diameter of the package is greater at the wider end of the bobbin, it is necessary to feed more yarn on to the bobbin at that end per axial unit of traverse than at the other end if the tension of the yarn on the bobbin is to be substantially uniform, which is desirable for weaving. Moreover the speed of the yarn 10 on to the package 40 is desirably at least 150 meters per minute, preferably 250 meters per minute or more. The cam groove 49 is shaped to achieve the necessary axial movement of the traverse arm 26 to achieve this.

The simplicity of the described traverse and feed mechanism is to be contrasted with a system in which the yarn 10 is passed through a yarn tension controller and is fed at a uniform speed on to the package from a traverse arm via a tension control arm which is designed to take up slack when the traverse arm is at the narrower end of the bobbin and release the taken-up slack when the traverse arm is at the wider end of the bobbin. Such a mechanism cannot reliably operate at the high speeds mentioned above and is more complicated and liable to breakdown than the arrangement herein described with reference to the drawings.

The traverse mechanism is suitable for use in other machines where it is desired to produce a tapered package when the yarn is fed to the package at a uniform speed.

It will be appreciated that the tapered package 40 may be used directly for weaving; this is to be contrasted with an arrangement in which a cylindrical package is wound and then this has to be re-wound into a conical package before it can be used in a weaving machine.

I claim:

1. A yarn traverse mechanism comprising: a yarn traverse arm, means for positively feeding yarn at a uniform speed to the yarn traverse arm, and arm moving means for moving the yarn traverse arm to and fro axially of a tapered bobbin to lay the yarn on the tapered bobbin to form a package, said arm moving means comprising a cam having a shape correlated with the degree of taper of the bobbin for varying the rate of axial movement of the arm as a function of the axial position of the arm in relation to the cam and thus to the diameter of the bobbin to maintain the tension of yarn laid on the bobbin substantially uniform.

2. A yarn traverse mechanism as claimed in claim 1, in which the cam is a rotatable scroll cam having a groove co-operable with the yarn traverse arm, the groove being shaped so that the yarn traverse arm completes one traverse to and fro for each eight revolutions of the scroll cam.

3. A yarn traverse mechanism as claimed in claim 2, in which the axial distances covered by the yarn traverse arm during eight successive revolutions of the cam, with the arm starting at the axial end of the groove corresponding to the wider end of the bobbin, are in the ratios 24:30:34:39:39:34:30:24.

4. A yarn traverse mechanism as claimed in claim 1 wherein the cam is rotatable to vary the axial position of the arm in relation to the cam, the axial distance traversed by the arm being different for successive rotations of the cam and wherein at least six rotations of the cam are required to move the arm through a complete traverse to and fro.

5. A yarn traverse mechanism comprising: a yarn traverse arm, means for positively feeding yarn at a uniform speed to the yarn traverse arm, and arm moving means for moving the yarn traverse arm to and fro axially of a tapered bobbin to lay the yarn on the tapered bobbin to form a package, said arm moving means comprising a cam having a shape correlated with the degree of taper of the bobbin for varying the rates of axial movement of the arm as a function of the axial position of the arm in relation to the cam and thus to the diameter of the bobbin thereby maintaining the radial thickness of yarn on the bobbin substantially uniform along the length of the bobbin.

* * * * *